US010406584B2

(12) United States Patent
Gorski et al.

(10) Patent No.: US 10,406,584 B2
(45) Date of Patent: Sep. 10, 2019

(54) METHODS AND APPARATUS TO SHAPE A WORKPIECE

(71) Applicant: Honda Motor Co., Ltd., Minato-ku, Tokyo (JP)

(72) Inventors: Peter Gorski, Alliston (CA); William Moore, Barrie (CA); Michael Athanassoulis, Palgrave (CA)

(73) Assignee: HONDA MOTOR CO., LTD., Tokyo (JP)

( * ) Notice: Subject to any disclaimer, the term of this patent is extended or adjusted under 35 U.S.C. 154(b) by 255 days.

(21) Appl. No.: 14/317,555

(22) Filed: Jun. 27, 2014

(65) Prior Publication Data

US 2015/0375287 A1 Dec. 31, 2015

(51) Int. Cl.

| | |
|---|---|
| ***B21D 35/00*** | (2006.01) |
| ***B21D 22/06*** | (2006.01) |
| ***B21D 28/32*** | (2006.01) |
| ***B21D 22/02*** | (2006.01) |
| ***B21D 28/00*** | (2006.01) |

(52) U.S. Cl.

CPC ..... *B21D 35/001* (2013.01); *B21D 22/02* (2013.01); *B21D 22/06* (2013.01); *B21D 28/32* (2013.01); *B21D 28/325* (2013.01); *B21D 28/002* (2013.01)

(58) Field of Classification Search

CPC ..... B21D 35/001; B21D 28/32; B21D 28/02; B21D 28/14; B21D 22/02; B21D 28/002; B21D 22/06; B21D 28/24; B21D 28/243; B21D 28/246; B21D 28/26; B21D 28/265; B21D 28/30; B21D 28/325; B21D 28/34; B21D 28/343; B21D 28/346; B21D 24/005; B21D 22/203; B21D 24/14

USPC ..... 72/349

See application file for complete search history.

(56) References Cited

U.S. PATENT DOCUMENTS

| | | | | |
|---|---|---|---|---|
| 4,392,400 A * | 7/1983 | Sasagawa | ..... | B21D 28/30 83/185 |
| 5,555,760 A * | 9/1996 | Kadis | ..... | B21D 28/26 72/334 |
| 5,941,110 A * | 8/1999 | Cao | ..... | B21D 22/02 72/20.1 |
| 7,013,783 B2 | 3/2006 | Matsuoka | | |

(Continued)

FOREIGN PATENT DOCUMENTS

JP H02217119 * 8/1990

OTHER PUBLICATIONS

Machine translation of JPH02217119, Sasahara et al., "Method of Machining Positioning Hole", Aug. 1990.*

(Continued)

*Primary Examiner* — Teresa M Ekiert

(74) *Attorney, Agent, or Firm* — Arent Fox LLP

(57) ABSTRACT

Methods and apparatus to shape a workpiece are disclosed herein. An exemplary apparatus includes a first die and a second die movable relative to the first die. The apparatus also includes a punch assembly movable relative to the second die and the first die during a stroke cycle of the second die to a position adjacent a workpiece disposed between the second die and the first die. The punch assembly includes a punch to be actuated to pierce the workpiece when the punch assembly is in the position adjacent the workpiece.

18 Claims, 6 Drawing Sheets

(56) References Cited

U.S. PATENT DOCUMENTS

| | | | | |
|---|---|---|---|---|
| 7,171,838 | B2 * | 2/2007 | Shiokawa | B21D 22/02 72/347 |
| 7,739,871 | B2 | 6/2010 | Cotter et al. | |
| 7,861,569 | B2 | 1/2011 | Cotter et al. | |
| 8,087,333 | B2 * | 1/2012 | Oishi | B21D 28/26 83/138 |
| 8,348,249 | B2 | 1/2013 | Cotter | |
| 8,444,122 | B2 | 5/2013 | Cotter et al. | |
| 2004/0020261 | A1 * | 2/2004 | Tokuda | B21D 22/02 72/334 |
| 2004/0123714 | A1 * | 7/2004 | Savoy | B21D 22/04 83/669 |
| 2005/0103177 | A1 * | 5/2005 | Kitamura | B21D 28/32 83/627 |

OTHER PUBLICATIONS

DADCO'S Power Cam and Power Pump System Inverted Animation, Youtube, Mar. 11, 2013. https://www.youtube.com/watch?feature=player_embedded&v=tEnD15PBJBo.

Kaller, "Flex Cam Catalogue," Kaller, Edition 9, Published 2010.

* cited by examiner

METHODS AND APPARATUS TO SHAPE A WORKPIECE

BACKGROUND

The subject matter disclosed herein relates to methods and apparatus to shape a workpiece.

A machine press traditionally includes a stationary die and a movable die. The movable die and the stationary die apply pressure to a workpiece supported in the machine press to bend or form the workpiece. The machine press may also include a punch to pierce a hole in the workpiece. Traditionally, the punch is disposed within the stationary die.

SUMMARY

In one aspect, an apparatus includes a first die. The apparatus also includes a second die movable relative to the first die through a first stroke cycle to stamp a workpiece. The apparatus further includes a pad movably coupled to the second die. The pad is movable through a second stroke cycle relative to the second die during the first stroke cycle. The apparatus also includes a punch assembly supported by the pad to move with the pad.

In another aspect, a method includes moving a punch assembly toward a first die and relative to a second die. The punch assembly is supported by a pad operatively coupled to the second die. The method also includes engaging a workpiece positioned between the first die and the pad and piercing the workpiece via the punch assembly.

In yet another aspect, an apparatus includes a first die and a second die movable relative to the first die. The apparatus also includes a punch assembly movable relative to the second die and the first die during a stroke cycle of the second die to a position adjacent a workpiece disposed between the second die and the first die. The punch assembly includes a punch to be actuated to pierce the workpiece when the punch assembly is in the position adjacent the workpiece.

BRIEF DESCRIPTION OF THE DRAWINGS

Aspects and advantages of examples disclosed herein are disclosed in the following detailed description, wherein similar structures have similar reference numerals.

DETAILED DESCRIPTION

Exemplary methods and apparatus to shape a workpiece are disclosed herein. An exemplary machine press disclosed herein may be used to stamp a workpiece and pierce one or more holes in the workpiece. In some embodiments, the machine press includes a first or lower die and a second or upper die movable relative to the lower die. A pad or blank holder is operatively coupled to the upper die to move with the upper die and move relative to the upper die. For example, as the upper die initiates a downstroke of a stroke cycle (e.g., movement from a fully raised position to a fully lowered position and back to the fully raised position), the pad moves with the upper die. As the upper die approaches the fully lowered position in which the upper die and the lower die are to stamp the workpiece, the pad moves toward the lower die relative to the upper die. As a result, the exemplary pad secures the workpiece prior to the upper die stamping the workpiece. In some embodiments, the pad is stationary relative to the lower die as the upper die stamps the workpiece. In some embodiments, when the upper die initiates an upstroke of the stroke cycle, the pad remains stationary relative to the lower die until the upper die reaches a given position in the upstroke. At the given position, the pad moves toward the upper die, and the upper die and the pad return to the fully raised position.

The exemplary machine press includes a cam or punch assembly within the pad such that the punch assembly moves with the pad and pierces one or more holes in the workpiece during the stroke cycle of the upper die. In some embodiments, the punch assembly initially activates prior to the pad contacting the workpiece. Then, in some such embodiments, the punch assembly pierces the hole(s) in the workpiece when the pad is stationary relative to the lower die and is in engagement with the workpiece.

In some embodiments, the punch assembly is actuated via a hydraulic system. In certain embodiments, the hydraulic system includes a piston that engages a piston actuator such as, for example, a protrusion to drive the piston. As a result, the piston generates a hydraulic force to actuate the punch assembly. In some embodiments, the hydraulic system is coupled to the upper die to move with the upper die, and the piston actuator is coupled to the lower die and aligned with the piston. As a result, when the hydraulic system moves toward the protrusion during the downstroke of the upper die, the piston engages the piston actuator, thereby actuating the piston and the punch assembly. Accordingly, in some embodiments, timing of the actuation of the punch assembly relative to the stamping of the workpiece is based on where the upper die and, thus, the hydraulic system are positioned along the stroke cycle when the piston engages the piston actuator.

Figure 1:
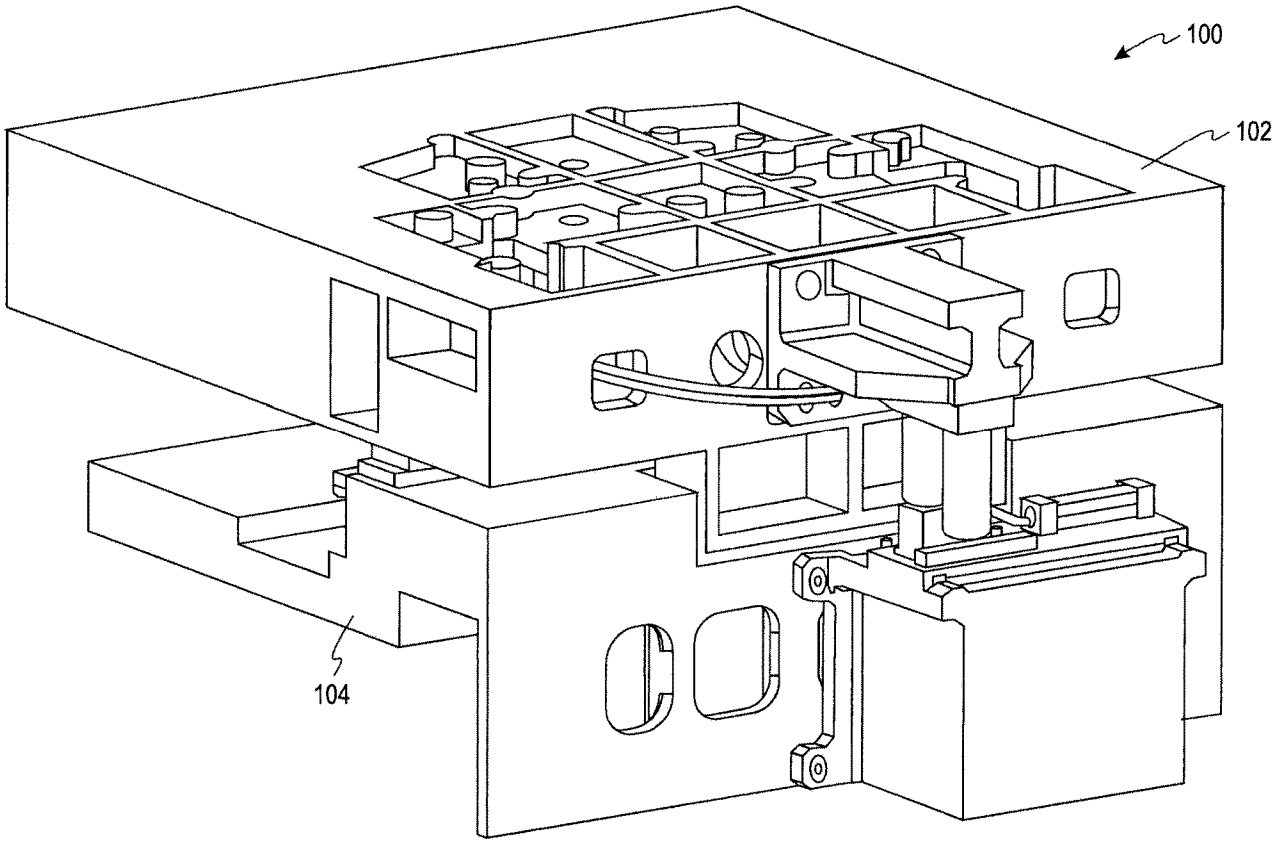
FIG. 1 is perspective view of an exemplary machine press disclosed herein including an upper die and a lower die.

FIG. 1 is a perspective view of an exemplary machine press 100 disclosed herein. In the illustrated embodiment, the machine press 100 includes an upper die 102 and a lower die 104. The lower die 104 of FIG. 1 is substantially fixed or stationary relative to a floor and/or a base upon which the machine press 100 is supported. A workpiece is to be disposed between the upper die 102 and the lower die 104. In some embodiments, the lower die 104 supports the workpiece. During operation of the machine press 100, the machine press 100 shapes the workpiece. For example, the machine press 100 may shape the workpiece by cutting or shearing the workpiece, bending the workpiece, piercing and/or punching one or more apertures or holes into the workpiece, stamping the workpiece, rolling the workpiece and/or performing one or more additional and/or alternative operations.

In the illustrated embodiment, the upper die 102 is disposed above the lower die 104 in the orientation of FIG. 1. In other embodiments, the upper die 102 and the lower die 104 may be configured in other orientations or configurations. For example, the upper die 102 and the lower die 104 may be arranged in a side-by-side configuration. In the illustrated embodiment of FIG. 1, the upper die 102 is movably coupled to the lower die 104 and the workpiece. During operation of the machine press 100, the upper die 102 moves through a stroke cycle to stamp the workpiece. In the illustrated embodiment, the stroke cycle includes movement of the upper die 102 from a first position (e.g., a fully raised position) toward the lower die 104 (downward in the orientation of FIG. 1.) to a second position (e.g., a fully lowered position) and then back to the first position. As described in greater detail below in conjunction with FIG. 5, when the upper die 102 of FIG. 1 moves through the stroke cycle, the machine press 100 shapes the workpiece by deforming the workpiece and punching or piercing a hole in the workpiece.

Figure 2:
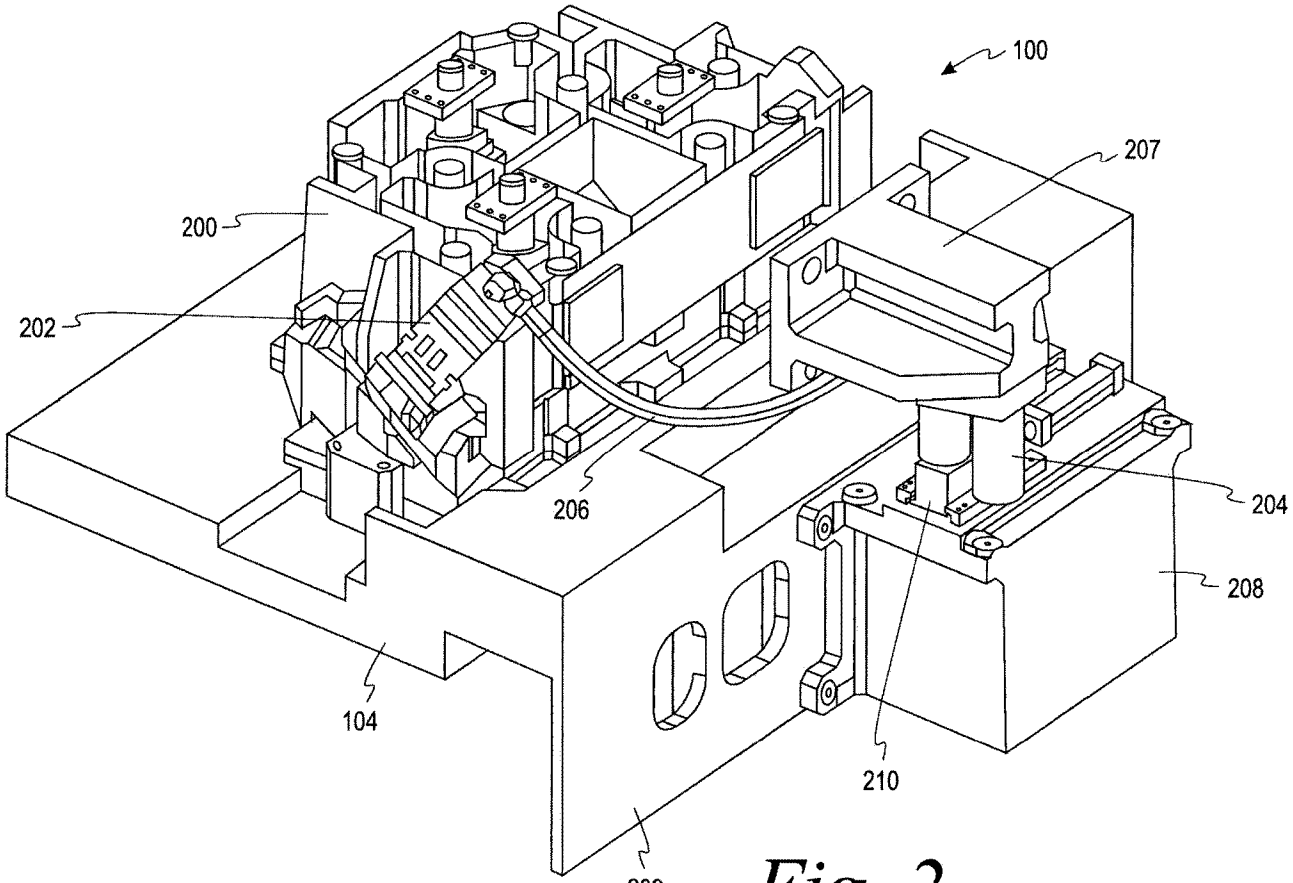
FIG. 2 is a perspective view of the exemplary machine press of FIG. 1 shown without the upper die to illustrate an exemplary pad disclosed herein.

FIG. 2 is a perspective view of the machine press 100 of FIG. 1 shown without the upper die 102. The machine press 100 includes a pad or blank holder 200. In the illustrated embodiment, the pad 200 is disposed between the upper die 102 and the lower die 104. The pad 200 of FIG. 2 is operatively coupled to the upper die 102 to move with the upper die 102 and relative to the upper die 102. During operation of the machine press 100, the pad 200 lowers to contact the workpiece, and the upper die 102 and the lower die 104 cooperate to deform (e.g., bend) a portion of the workpiece. For example, the pad 200 may be lowered to contact the workpiece and secure the workpiece in place between the lower die 104 and the pad 200. Once the workpiece is secured, the upper die 102 moves into the second position and cooperates with the lower die 104 to apply pressure to the workpiece to deform the workpiece.

Figure 4:
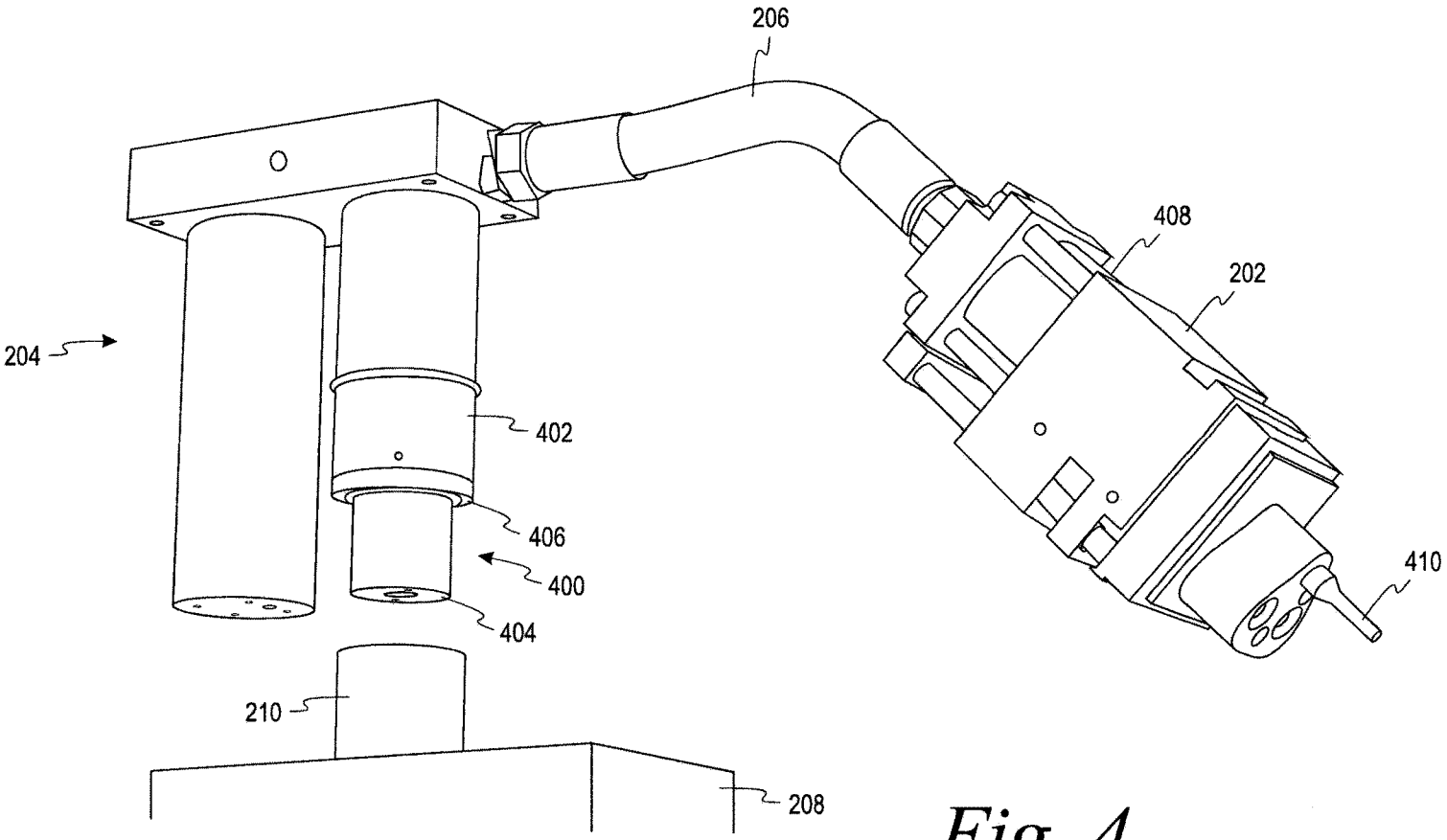
FIG. 4 is a perspective view of the exemplary punch assembly of FIG. 3 and an exemplary hydraulic system disclosed herein that may be used to implement the exemplary machine press of FIG. 1.

In the illustrated embodiment, the machine press 100 includes a punch assembly 202 and a hydraulic system 204. In other embodiments, the machine press 100 includes more than one punch assembly and/or hydraulic system. The hydraulic system 204 of FIG. 2 is in hydraulic communication with the punch assembly 202 via a hose 206. During the stroke cycle of the upper die 102, the punch assembly 202 extends and retracts a punch 410, as shown in FIG. 4, to pierce a hole in the workpiece. The punch assembly 202 extends and retracts the punch 410 via a hydraulic force applied to the punch assembly 202 via the hydraulic system 204. In the illustrated embodiment, the punch assembly 202 is supported by and disposed in the pad 200. Thus, during operation of the machine press 100, the punch assembly 202 moves relative to the lower die 104, the workpiece and the upper die 102. The punch assembly 202 of FIG. 2 is oriented at an angle relative to a path of the upper die 102. In the illustrated embodiment, the path of the upper die 102 is along a substantially vertical axis in the orientation of FIG. 2. As a result, the punch assembly 202 extends the punch 410 at an angle relative to (e.g., non-parallel to) the path of the upper die 102. In other embodiments, the punch assembly 202 is oriented such that the punch 410 extends substantially parallel to the path of the upper die 102.

In the illustrated embodiment, the hydraulic system 204 is coupled to an upper mount 207. The upper mount 207 is coupled to an exterior 504 (shown in FIG. 5) of the upper die 102. As a result, the upper mount 207 and the hydraulic system 204 move with the upper die 102 during operation of the machine press 100. As described in greater detail below, the hydraulic system 204 of FIG. 2 includes a piston 400, as shown in FIG. 4. In the illustrated embodiment, a lower mount 208 is coupled to an exterior 209 of the lower die 104. An exemplary piston actuator 210 is coupled to the lower mount 208. In the illustrated embodiment, the lower mount 208 is disposed below the upper mount 207 such that the piston actuator 210 is aligned with the piston 400 of the hydraulic system 204. As a result, when the upper die 102 moves toward the lower die 104, the piston actuator 210 engages (e.g., contacts) the piston 400 to generate the hydraulic force that is applied to the punch assembly 202 to deploy the punch 410.

In other embodiments, the hydraulic system 204 and/or the piston actuator 210 are coupled to the machine press 100 in other ways. For example, in one embodiment, the hydraulic system 204 is coupled to the lower mount 210, and the piston actuator 210 is coupled to the upper mount 207. In some embodiments, the machine press 100 does not include the upper mount 207 and/or the lower mount 208 and, thus, the hydraulic system 204 and/or the piston actuator 210 is coupled to different portions of the machine press 100 than illustrated in FIG. 2. In some embodiments, the hydraulic system 204 and/or the piston actuator 210 are not coupled to the machine press 100. For example, the piston actuator 210 may be supported by a base or a fixture disposed adjacent the machine press 100.

Figure 3:
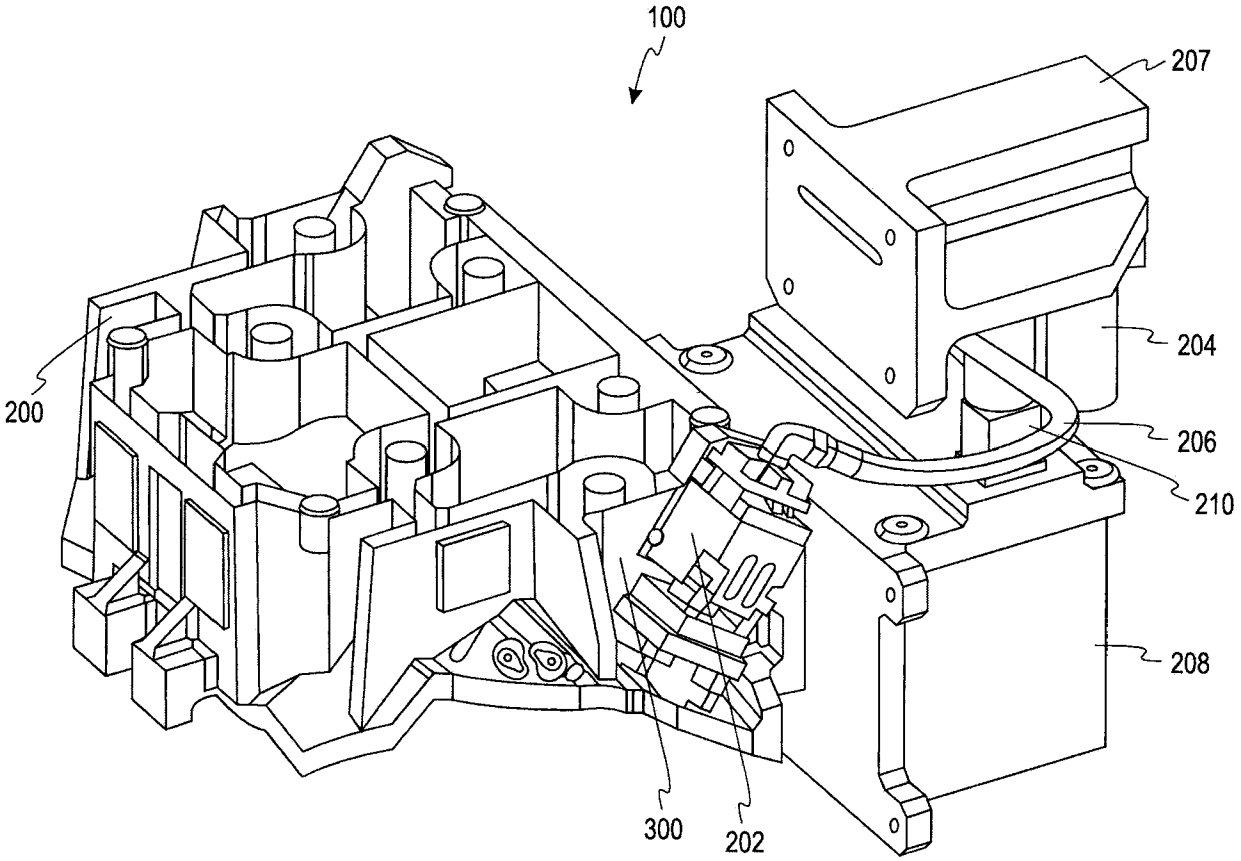
FIG. 3 is a perspective view of an exemplary punch assembly supported by the exemplary pad of FIG. 2.

FIG. 3 is a perspective view of the pad 200 and the punch assembly 202. In the illustrated embodiment, the punch assembly 202 is supported in a compartment or cavity 300 defined by the pad 200. In some embodiments, the punch assembly 202 is keyed to the pad 200. In some embodiments, the punch assembly 202 is supported by and/or mounted to the pad 200 via one or more brackets, supports, fasteners and/or one or more additional and/or alternative techniques. In the illustrated embodiment, the punch assembly 202 is supported by the pad 200 such that the punch assembly 202 extends the punch 410 through an aperture 500 (shown in FIG. 5) of the pad 200 to pierce the workpiece.

FIG. 4 illustrates the punch assembly 202, the hydraulic system 204 and the piston actuator 210 of FIGS. 2 and 3. In the illustrated embodiment, the hydraulic system 204 includes the piston 400 and a hydraulic cylinder 402. The piston 400 is disposed inside and movably coupled to the hydraulic cylinder 402. The piston 400 of FIG. 4 includes a piston rod 404 extending out of an axial end 406 of the hydraulic cylinder 402. The piston actuator 210 of FIG. 4 is a cylindrical protrusion. In other embodiments, the piston actuator 210 is a protrusion or projection having any suitable shape. In the illustrated embodiment, when the hydraulic system 204 is lowered with the upper die 102, the piston rod 404 contacts the piston actuator 210. As a result, the piston actuator 210 actuates the piston 400 from an unactuated position to an actuated position. In the illustrated embodiment, the piston actuator 210 drives the piston 400 upward relative to the hydraulic cylinder 402 in the orientation of FIG. 4. As a result, the piston 400 generates a hydraulic force that is transferred to the punch assembly 202 via fluid in the hydraulic cylinder 402 and the hose 206. In some embodiments, the machine press 100 employs one or more additional and/or alternative types of piston actuators.

In the illustrated example, the punch assembly 202 includes a housing 408 and a punch 410. The example punch 410 deploys (e.g., extends) under the influence of the hydraulic force applied to the punch assembly 202 via the hydraulic system 204. When the hydraulic system 204 is raised with the upper die 102 relative to the lower die 104, the piston 400 moves from the actuated position back to the unactuated position. As a result, the example punch 410 retracts at least partially into the housing 408.

Figure 5:
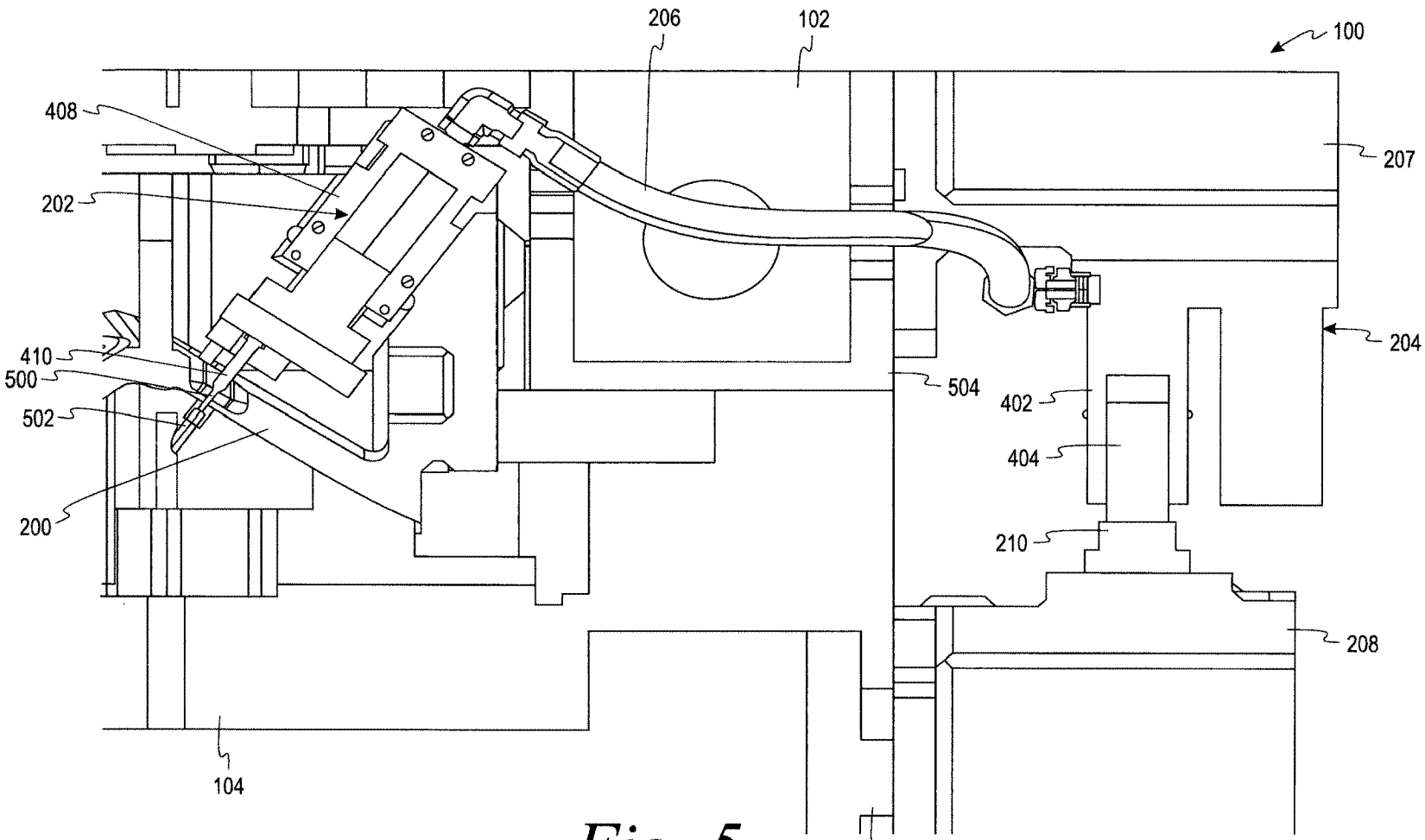
FIG. 5 is a sectional view of the exemplary machine press of FIG. 1 including the exemplary punch assembly and the exemplary hydraulic system of FIG. 4.

FIG. 5 is a sectional view of the example machine press 100 of FIG. 1. In the illustrated embodiment, the upper die 102 is in the second position (e.g., the fully lowered position). As a result, the upper die 102 is positioned to bring or urge the pad 200 into contact with the workpiece (not shown) and to cooperate with the lower die 104 to apply pressure to the workpiece to shape the workpiece. In addition, the hydraulic system 204 is positioned with the upper die 102 via the upper mount 207 such that the piston actuator 210 engages the piston 400 to position the piston 400 in the actuated position. As a result, the piston 400 generates the hydraulic force and the punch 410 extends through the aperture 500 of the pad 200 and into a receptacle 502 of the lower die 104 to pierce a hole in the workpiece. As described above in reference to FIG. 2, the upper mount 207 is coupled to the exterior 504 of the upper die 102, and the lower mount 208 is coupled to an exterior 209 of the lower die 104. Thus, the hydraulic system 204 and the piston actuator 210 do not occupy space between the upper die 102 and the lower die 104.

In the illustrated embodiment, the pad 200 moves with the upper die 102 during portions of the stroke cycle of the upper die 102. In addition, the pad 200 moves through a stroke cycle relative to the upper die 102 during the stroke cycle of the upper die 102. As a result, the pad 200 moves the punch assembly 202 to a position adjacent the workpiece to enable the punch 410 to be actuated to pierce the workpiece when the punch assembly 202 is in the position adjacent the workpiece.

In the illustrated embodiment, the pad 200 moves with the upper die 102 during an initial portion of a downstroke of the stroke cycle of the upper die 102 (e.g., as the upper die 102 moves from the first position toward the lower die 104). Then, the pad 200 moves away from the upper die 102 (e.g., toward the lower die 104) as the upper die 102 approaches the second position. As a result, the pad 200 engages the workpiece and/or the lower die 104 before the upper die 102 engages the workpiece, thereby securing the workpiece prior to the upper die 102 and the lower die 104 cooperating to shape the workpiece. Further, the pad 200 moves the punch assembly 202 into the position adjacent the workpiece such that the punch 410 is aligned with the receptacle 502.

In some embodiments, the pad 200 remains stationary relative to the lower die 104 as the upper die 102 moves into the second position to shape the workpiece. In some embodiments, when the upper die 102 initially moves from the second position back toward the first position, the pad 200 remains stationary relative to the workpiece and the lower die 104. The pad 200 then moves away from the lower die 104 and toward the upper die 102 to disengage the workpiece. Then, in some embodiments, the pad 200 moves with the upper die 102 as the upper die 102 returns to the first position.

Thus, during a middle portion of the stroke cycle of the upper die 102, the pad 200 moves through its stroke cycle relative to the upper die 102. In the illustrated embodiment, the upper die 102 moves though its stroke cycle in five seconds, and the pad 200 moves through its stroke cycle in 0.3 seconds. However, the above-noted amounts of time are merely examples and, thus, the upper die 102 and/or the pad 200 may move through stroke cycles in any suitable amount of time without departing from the scope of this disclosure. In the illustrated embodiment, because the hydraulic system 204 moves with the upper die 102, and the punch assembly 202 moves with the pad 200, the punch assembly 202 moves relative to the hydraulic system 204 during at least a portion of the stroke cycle of the pad 200.

In the illustrated embodiment, the piston actuator 210 actuates the piston 400 during a portion of the stroke cycle of the pad 200 relative to the upper die 102. In some embodiments, the piston actuator 210 actuates the piston 400 such that the punch 410 initially deploys prior to the pad 200 contacting the workpiece. For example, in some embodiments, the piston actuator 210 initially engages the piston 400 when the pad 200 is vertically spaced apart from the piston actuator 210 by approximately 20 millimeters (e.g., the pad 200 is disposed at a height above the piston actuator 210 when the piston 400 initially engages the piston actuator 210). In other embodiments, the pad 200 and the piston 400 are vertically spaced apart by other distances. As a result, the piston 400 generates the hydraulic force to initially actuate the punch assembly 202 prior to the pad 200 contacting the workpiece.

Then, in some such embodiments, the pad 200 moves into contact with the workpiece, and the punch 410 pierces the workpiece and begins to retract when the pad 200 is stationary relative to the lower die 104. As a result, the punch 410 extends into the receptacle 502 and begins to withdraw from the receptacle 502 while the punch assembly 202 is stationary relative to the workpiece and the lower die 104. In some embodiments, the punch 410 is fully extended when the pad 200 is approximately 25-35 millimeters into the stroke cycle of the pad 200. In some embodiments, the pad 200 moves approximately 0-10 millimeters while the punch 410 withdraws from the receptacle 502. In some embodiments, the punch 410 continues to retract while the piston actuator 210 and the piston 400 remain in engagement as the upper die 102 moves away from the lower die 104. For example, the piston actuator 210 and the piston 400 may remain in engagement until the upper die 102 moves approximately 55 millimeters from a fully lowered position. However, the above-noted dimensions are merely examples, and thus, other dimensions may be used without departing from the scope of this disclosure.

The above-disclosed timing of the actuation of the piston 400 enables the punch 410 to be deployed and retracted without contacting the lower die 104, facilitates accurate and consistent piercing of workpieces, and/or provides additional and/or alternative benefits. In the illustrated embodiment, the punch 410 deploys and retracts in 0.03 seconds. In other embodiments, the punch 410 deploys and retracts in any suitable amount of time.

Figure 6:
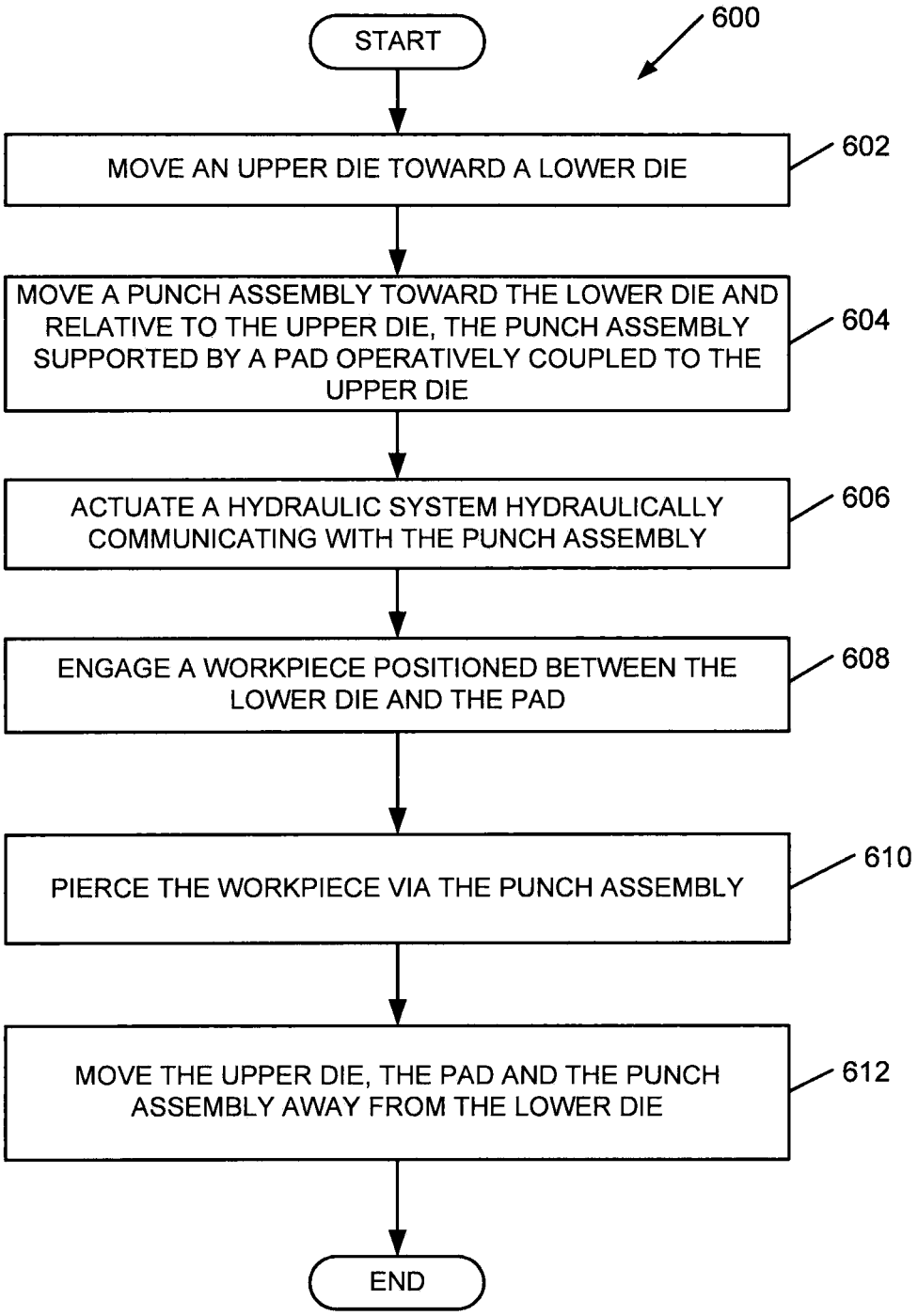
FIG. 6 is a flowchart representative of an exemplary method to shape a workpiece in accordance with the teachings of this disclosure.

FIG. 6 is a flowchart representative of an exemplary method 600 to shape a workpiece in accordance with the embodiments described herein. The method 600 of FIG. 6 begins when the upper die 102 moves toward the lower die 104 (block 602). The punch assembly 202 moves toward the lower die 104 and relative to the upper die 102 (block 604). For example, as described above in reference to FIG. 5, the punch assembly 202 is supported by the pad 200, and the pad 200 moves toward the lower die 104 and relative to the upper die 102 as the upper die 102 approaches the second position (e.g., a fully lowered position). The punch assembly 202 moves with the pad 200 and, thus, moves toward the lower die 104 and relative to the upper die 102.

The hydraulic system 204 is actuated (block 606). The hydraulic system 204 of FIGS. 2-5 is in hydraulic communication with the punch assembly 202 to transfer a hydraulic force to the punch assembly 202. As described in greater detail below, the piston rod 404 engages and disengages the piston actuator 210 to actuate the hydraulic system 204 during a stroke cycle of the pad 200 relative to the upper die 102. In the machine press 100 of FIGS. 1-5, the hydraulic system 204 initially activates the punch assembly 202 and, thus, initially deploys the punch 410 when the piston rod 404 engages the piston actuator 210 as the hydraulic system 204 is lowered with the upper die 102. In the illustrated embodiment, the pad 200 then engages a workpiece positioned between the lower die 104 and the pad 200 (block 608). Thus, in some embodiments, the hydraulic system 204 initially activates the punch assembly 202 prior to the pad 200 contacting the workpiece supported on the lower die 104. In some embodiments, the pad 200 engages the workpiece to hold the workpiece in place as the workpiece is shaped by the machine press 100.

The workpiece is pierced via the punch assembly 202 (block 610). In some embodiments, the punch 410 extends and retracts to pierce the workpiece when the pad 200 is engaged to the workpiece and the punch assembly 202 is stationary relative to the lower die 104. Once the workpiece is shaped (e.g., stamped via the upper die 102 and the lower die 104 and pierced via the punch 410), the upper die 102, the pad 200 and the punch assembly 202 move away from the lower die 102 (block 612). In some embodiments, when the hydraulic system 204 is raised with the upper die 102, the piston rod 404 moves out of engagement with the piston actuator 210, and the punch 410 fully retracts at least partially into the housing 408 of the punch assembly 202. The workpiece may then be removed from the machine press 100 to be further shaped and/or assembled with one or more components of a device such as, for example, an automobile.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather, it is hereby intended that the scope be defined by the claims appended hereto. Additionally, the features of various implementing embodiments may be combined to form further embodiments.

What is claimed is:

1. An apparatus, comprising:

a first die;

a second die movable relative to the first die through a first stroke cycle to stamp a workpiece;

a pad movably coupled to the second die, the pad movable through a second stroke cycle relative to the second die during the first stroke cycle; and a punch assembly supported by the pad to move with the pad, wherein the punch assembly is configured to pierce a hole in the workpiece at an angle relative to a path of the second die, wherein the punch assembly includes a punch to be actuated to pierce the workpiece when the punch assembly is in a position adjacent to the workpiece, and wherein the punch is retractable by the punch assembly and is configured to be initially actuated prior to the pad contacting the workpiece.

2. The apparatus of claim 1, further comprising a hydraulic system, the hydraulic system in hydraulic communication with the punch assembly, wherein the hydraulic system is configured to actuate the punch assembly during the second stroke cycle of the pad.

3. The apparatus of claim 2, wherein the hydraulic system comprises a piston, the apparatus further comprises a piston actuator, and the piston actuator is configured to actuate the piston during the first stroke cycle of the second die to generate a hydraulic force to actuate the punch assembly.

4. The apparatus of claim 3, wherein the piston actuator comprises a protrusion, the protrusion engaging the piston when the second die moves towards to the first die.

5. The apparatus of claim 3, wherein one of the piston actuator and the hydraulic system is coupled to an exterior of the second die.

6. The apparatus of claim 3, wherein one of the piston actuator or the hydraulic system is coupled to an exterior of the first die.

7. The apparatus of claim 2, wherein the punch assembly is movable relative to the hydraulic system during the second stroke cycle.

8. An apparatus, comprising:

a first die;

a second die movable relative to the first die;

a punch assembly movable relative to the second die and the first die during a stroke cycle of the second die to a position adjacent a workpiece disposed between the second die and the first die, the punch assembly including a punch to be actuated to pierce the workpiece when the punch assembly is in the position adjacent the workpiece, wherein the punch assembly is configured to pierce a hole in the workpiece at an angle relative to a path of the second die; and a pad coupled to the second die, the punch assembly coupled to the pad to move with the pad, wherein the punch is retractable by the punch assembly and is configured to be initially actuated prior to the pad contacting the workpiece.

9. The apparatus of claim 8, further comprising a hydraulic system configured to actuate the punch, wherein the hydraulic system does not occupy a space between the second die and the first die.

10. The apparatus of claim 8, further comprising a hydraulic system operatively coupled to one of the second die or the first die.

11. The apparatus of claim 10, wherein the hydraulic system further comprises a piston, the apparatus further comprising a protrusion engaging the piston of the hydraulic system.

12. The apparatus of claim 11, wherein the punch assembly is coupled to the pad operatively coupled to the second die, and the protrusion engages the piston only during a stroke cycle of the pad relative to the second die.

13. An apparatus, comprising:

a first die;

a second die movable relative to the first die through a first stroke cycle to stamp a workpiece;

a pad movably coupled to the second die, the pad movable through a second stroke cycle relative to the second die during the first stroke cycle;

a punch assembly supported by the pad to move with the pad, wherein the punch assembly includes a punch to be actuated to pierce the workpiece when the punch assembly is in a position adjacent to the workpiece, and wherein the punch is retractable by the punch assembly and is configured to be initially actuated prior to the pad contacting the workpiece; and a hydraulic system, the hydraulic system in hydraulic communication with the punch assembly, wherein the hydraulic system is configured to actuate the punch assembly during the second stroke cycle.

14. The apparatus of claim 13, wherein the hydraulic system comprises a piston, the apparatus further comprises a piston actuator, and the piston actuator is configured to actuate the piston during the first stroke cycle of the second die to generate a hydraulic force to actuate the punch assembly.

15. The apparatus of claim 14, wherein the piston actuator comprises a protrusion, the protrusion engaging the piston when the second die moves towards to the first die.

16. The apparatus of claim 14, wherein one of the piston actuator and the hydraulic system is coupled to an exterior of the second die.

17. The apparatus of claim 14, wherein one of the piston actuator or the hydraulic system is coupled to an exterior of the first die.

18. The apparatus of claim 13, wherein the punch assembly is movable relative to the hydraulic system during the second stroke cycle.

* * * * *